United States Patent [19]

Troncosco, Jr.

[11] 3,935,854

[45] Feb. 3, 1976

[54] ARCHERY BOW AND ARROW SUPPORT

[76] Inventor: Fernando Troncosco, Jr., 1851 S. Orange Ave., Monterey Park, Calif. 91754

[22] Filed: Dec. 4, 1974

[21] Appl. No.: 529,444

[52] U.S. Cl. ..... 124/24 R; 124/41 A
[51] Int. Cl.[2] ..... F41B 5/00
[58] Field of Search ..... 124/41 A, 24 R

[56] References Cited

UNITED STATES PATENTS

| | | | |
|---|---|---|---|
| 3,372,686 | 3/1968 | Losh | 124/41 A X |
| 3,504,659 | 4/1970 | Babington | 124/41 A X |

*Primary Examiner*—Richard C. Pinkham
*Assistant Examiner*—William R. Browne
*Attorney, Agent, or Firm*—Donald E. Nist

[57] ABSTRACT

Improved archery equipment comprises an archery bow with an improved reversible arrow rest. The equipment may also include an arrow supported on the rest for shooting from the bow. The rest is disposed in the arrow-receiving space or window of the bow, and comprises a base portion secured to the bow handle and at least one resilient, vertically depressible, elongated, free-standing, upwardly projecting arm rising above the base support and secured to it adjacent its lower end. The arm extends generally along the forward-rearward axis of the bow, a portion of the arm providing a fork, tines of which are adapted to support opposite sides of an arrow below the midline thereof when the arrow is disposed for shooting from the bow. In one embodiment a pair of spaced arms are utilized in the rest and the fork has an open center, thus permitting an arrow vane to pass freely therethrough without touching the fork. The arm or arms are adjustable preferably both vertically and laterally so that the height and position of the arrow in the window can be adjusted. the open centered fork can also be adjusted to accommodate arrows of various diameters. The same rest can be used with both right handed and left handed bows and is particularly adapted to be used in conjunction with a mechanical string release to provide essentially perfect arrow flight with full arrow clearance from the bow.

11 Claims, 10 Drawing Figures

ARCHERY BOW AND ARROW SUPPORT

BACKGROUND

1. Field of the Invention

The present invention generally relates to archery equipment and more particularly relates to improved archery equipment comprising a bow with an improved arrow rest attached thereto, with or without an arrow on the rest.

2. Prior Art

Arrow rests for archery bows, such as the longbow, modernly the recurved bow, usually includes a ledge connected to the sidewall of the bow in the so-called window of the bow above the bow shelf. The bow shelf defines the lower margin of the window, the latter being disposed in the handle or middle portion of the bow between the bow limbs and above the hand grip. The arrow rest ledge usually projects generally horizontally out into the window and can be fabricated of any suitable material such as metal, plastic, leather, bristles, feathers, paper or the like.

The purpose of the arrow rest is to form a support for the arrow shaft so that it can be accurately aimed and shot from the bow. In order to shoot the arrow, its rear or nock end is nocked on the string, and the shaft is placed on and supported by the arrow rest ledge. The bowstring, which is attached to the limb tips, is then drawn towards the archer, either with the fingers of one hand or with a mechanical release attached to one or more of those fingers or to the wrist, while the other hand of the archer holds the bow at arms length in about vertical alignment. The drawing fingers, when used instead of a mechanical release, are usually protected by a finger tab or glove. When the string is fully drawn back, the arrow is aimed and then the string is released. The bent bow limbs force the released string and nocked arrow rapidly forward, the string reaches its forward limit of movement, constrined by the limbs, and the arrow launches forward, free of the string and directed to the target.

In moving forward from the string, the arrow vanes, attached adjacent the rear of the arrow shaft for stabilization of the arrow, usually clears a well constructed arrow rest ledge if the archer's fingers rather than a mechanical release have been used to draw the bow string. This is due to the phenomenon known as archers paradox. This phenomenon is characterized by a bowing or bending of the arrow shaft around the arrow rest ledge, and consequent clearing the vanes, due to the sudden propulsive force delivered by the string to the rear end of the arrow shaft in a plane other than along the exact longitudinal axis of the shaft. This misalignment of string force imparted to the arrow is caused by the side torque naturally given to the string as the string rolls or slides across the finger tab or glove fingers at an angle from the described plane during release of the string. During flight, the arrow so released goes through a series of diminishing alternate flexing and bowing motions, all of which tend to reduce its accuracy. Moreover, not all of the propulsive force possible is imparted by the string to the arrow, nor is all that which is so imparted directed towards the target. Consequently, arrow speed and accuracy are further reduced.

In recent years, the described deficiencies have been largely overcome through the use of mechanical release aids. One type of such release aids usually comprises a hook of metal, plastic or the like which is held in the archer's hand, controlled by the fingers and features essentially point contact with the bow string, resulting in the latter being released more uniformly from shot to shot, and more in a plane along the longitudinal axis of the arrow. Essentially the same advantages are obtained with certain other types of mechanical releases, such as certain rope and strap releases. Consequently, more propulsive force is imparted to the arrow, it travels faster and more accurately and archers paradox is substantially eliminated.

However, difficulties in having the arrow and its vanes clear the arrow rest ledge are usually encountered when using mechanical release aids because archers paradox has been largely eliminated. If a vane of the arrow strikes the ledge during flight of the arrow, the vane rapidly becomes worn, does not properly stabilize the arrow and must be replaced. Moreover, such striking causes the arrow to be knocked out of the desired trajectory and to be slowed down, resulting in reduced accuracy of the shot. The problem is most pronounced when relatively inflexible hard plastic vanes are used in place of feathers. Such hard vanes are weather resistant, more uniform and have less wind resistance than feathers and so are more accurate. However, if any of them on the arrow touch the arrow rest ledge during flight of the arrow, the shot is thrown well off line and accuracy is sharply reduced.

Some shaft positioning devices have recently been used to position the arrow shaft on the rest far enough away from the bow side wall and the main portion of the rest to reduce the problem of vane interference. However, when such devices are uncollapsable, a new problem is introduced in that the arrow frequently is misaligned, that is, it is not initially parallel with the bow sidewall and is not disposed directly along the forward-rearward axis of the bow. Consequently, it flies off line. Moreover, the transmission of force from the string to the arrow is at an angle, with consequent reduction in arrow speed and accuracy. If on the other hand, the shaft-positioning device is collapsable, such as the so-called plunger, arrow vane clearance is again encountered because archers paradox is further suppressed and the arrow shaft tends to swing towards the sidewall before the vanes clear the rest.

A further complication has been introduced through the use of most mechanical release aids. Thus, slow motion pictures have revealed that arrows shot with mechanical releases, especially those featuring single point contact with the bowstring, undergo substantial and rapid vertical oscillations due, probably at least in part, to the fact that the arrow must be nocked on the string well above the arrow rest level in order to aid in clearing the arrow vanes. Such oscillations can adversely affect accuracy in shooting. Although they are minimal when a finger tab or glove is used in place of the mechanical release, since the tab or glove dampens the oscillations, the substantial improvement in overall accuracy otherwise afforded by mechanical releases points out the need for a way of overcoming such vertical oscillations.

Accordingly, there is a need for improved means for assuring, during archery bow shooting with all types of mechanical release aids, proper arrow shaft and vane clearance, suppression or elimination of vertical arrow oscillation and archers paradox and improved accuracy from shot to shot.

SUMMARY OF THE INVENTION

The present invention satisfies the foregoing needs. The invention is substantially as set forth in the Abstract above. Thus, improved archery equipment is provided which includes an improved arrow rest disposed in the window of an archery bow. The rest comprises a base support secured to the handle or middle portion of the bow and at least one and, in one embodiment, a pair of resilient, vertically depressable, elongated, free-standing, upwardly projecting arms rising above and secured at their lower ends to the base support. The arm or arms form an arrow support, permitting a vane of the arrow to pass freely therearound or therebetween. The arms are adjustable preferably both vertically and laterally, that is, towards and away from each other, so as to accommodate therebetween arrow shafts of various diameters.

When utilizing a mechanical release, an arrow is shot from the bow with the arrow shaft supported on the improved rest, no archers paradox is encountered, vertical oscillations are effectively dampened and complete vane clearance is afforded, so that full propulsive force is transmitted from the bowstring to the arrow and the arrow travels straight ahead to the target at maximum speed and with optimal accuracy, without substantial lateral or vertical oscillations. Extreme accuracy from shot to shot thus can be achieved. Moreover, this result is obtained regardless of the type of mechanical release employed. It will also be understood that a finger tab or glove can be used in place of the mechanical release with certain of the described advantages, but with decreased accuracy. Such use is not recommended.

It has also been found that when the arrow is shot from the improved rest, using a mechanical release, the natural breaking or movement of the bow arm out of direct alignment with the target, upon release of the arrow, has minimal effect on the accuracy of the arrow, in contrast to arrows shot using a fixed pressure point or collapsable plunger in association with a ledge rest.

A further unique feature of the improved arrow rest is that it is equally adaptable for use with both right and left handed archery bows. There is no need to provide separate mirror image forms of the rest, one for left-handed applications and one for right-handed applications. Accordingly, a saving in inventory costs can be made while increasing the overall utility of the improved equipment. Further features of the invention are set forth in the following detailed descriptions and accompanying drawings.

DRAWINGS

DETAILED DESCRIPTION

Figure 1:
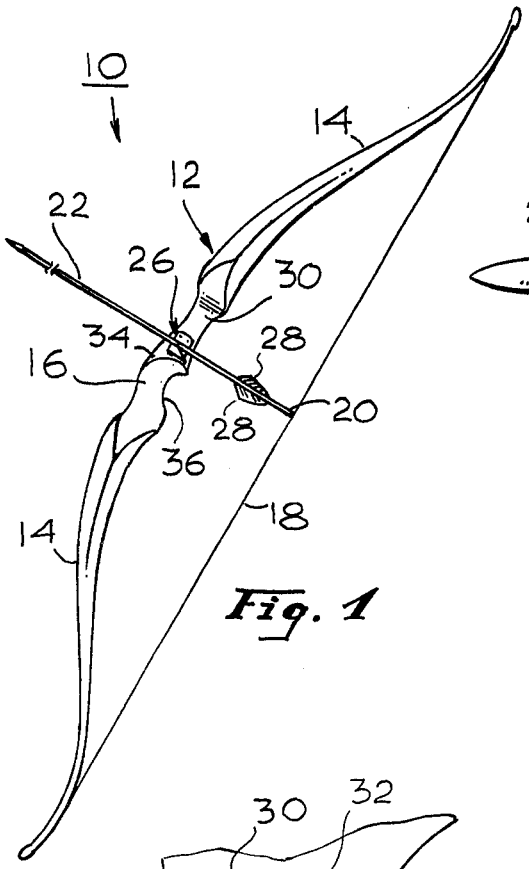
FIG. 1 is a schematic reduced side elevation of a first preferred embodiment of the improved archery equipment of the invention.
Figure 2:
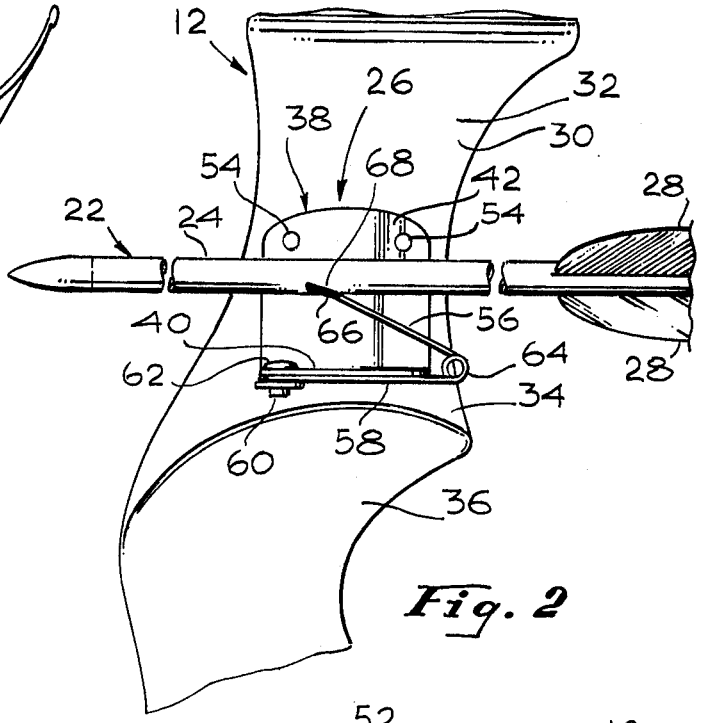
FIG. 2 is a schematic fragmentary side elevation of the center portion of the bow of FIG. 1, showing an arrow in place on said first embodiment on the improved rest of the invention.
Figure 3:
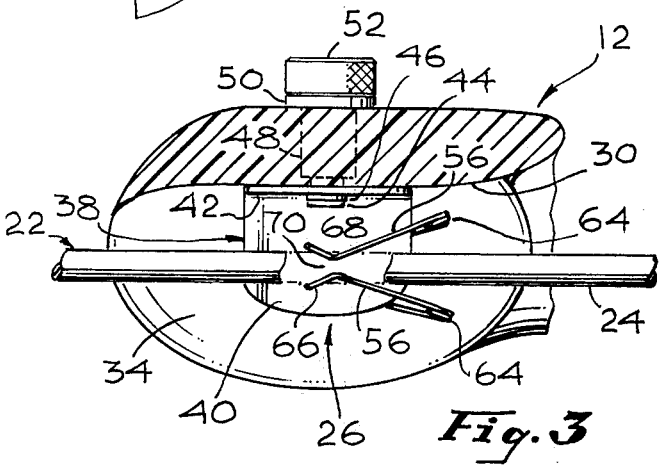
FIG. 3 is a top plan view of the equipment shown in FIG. 2.

FIGS. 1, 2 and 3

As shown schematically in FIG. 1 in side elevation, a preferred embodiment of improved archery equipment is provided, comprising device 10 which includes an archery long bow 12 having a pair of elongated recurved limbs 14 interconnected by a middle or handle portion 16. The tips of limbs 14 are secured to opposite ends of a bowstring 16, to which the rear or nock end 20 of an arrow 22 is attached at about the mid-point of string 18. The shaft 24 of arrow 22 is supported on an improved arrow rest 26, with the vanes 28 of arrow 22 rearward of rest 26. Bow 12 and arrow 22 can be made in any suitable conventional manner.

Rest 26, shown in FIGS. 2 and 3, is secured to sidewall 30 of bow 12 in the "cut-away" or window 32 in the handle portion 16 above shelf 34. Shelf 34 is, in turn, above handgrip 36. Rest 26 comprises an L-shaped plate 38 of metal, plastic or the like, having a horizontal base 40 and an interconnected vertical portion 42. The latter is secured to sidewall 30 by a screw 44 and washer 46 secured to a shaft 48 passing through portion 42 and extending transversely through sidewall 30. Shaft 48 has an enlarged head 50 to which a knurled knob 52 is threadably secured. Portion 48 may be provided with apertures 54 through which the shaft of screws (not shown) can be passed into sidewall 30 as an alternate means of securing plate 38 in place above shelf 34 a desired distance.

A pair of spaced, vertically depressible, elongated freestanding arms 56 project upwardly and forwardly at an angle in window 32, rising above base 40 and spaced from sidewall 30 a desired distance. Arms 56 lie generally in a forward-rearward direction, that is, generally parallel to sidewall 30. The lower ends 58 of arms 56 are releasably secured to base 40, for example, by being pressed between the underside of base 40 and a nut 60 disposed on threaded machine screw 62 or the like extending down through base 40, as shown in FIG. 2.

Preferably, arms 56 are formed of a single piece or strip of high tensile strength, flexible bendable wire, such as metal wire, for example, steel wire, or plastic wire or the like, so that arms 56 are joined at the lower ends 58 thereof. Arms 56 may, if desired, have one or more coils 64 therein to increase their vertical spring action, as shown in FIGS. 2 and 3. Such vertical depressibility effectively dampens vertical oscillations of arrow 22 when the latter is shot from rest 26, increasing arrow accuracy.

Arms 56 converge toward but do not touch each other adjacent their upper ends 66 and preferably diverge at those ends 66, as shown in FIG. 3, providing a fork 68, the tines of which support shaft 24 of arrow 22 on opposite sides below the midline thereof, leaving a space 70 therebetween for free passage therethrough of a vane 28 of screw 22 without touching arms 56. Accordingly, arrow 22 can be shot without any vane interference, thereby increasing arrow accuracy.

Arms 56 can be bent up and down to position shaft 24 properly vertically. Arms 56 can also be bent towards and away from each other so as to make fork 68 the proper diameter for shaft 24, whatever shaft 24's diameter. Inasmuch as ends 66 or fork 68 preferably are straight sided, although diverging, and shaft 24 is circular in cross-section, there is point contact between the tines of fork 68 and shaft 24 for minimal arrow drag when arrow 22 is shot.

Accordingly, rest 26 permits arrow 22 to be shot by a mechanical release aid without vertical oscillation, archer's paradox and vane interference. Such an arrangement exhibits increased arrow speed and accuracy, shot after shot, and is a substantial advance in the art.

Although arrow 22 could be shot with a tab or glove instead of a mechanical release aid, space 70 would have to be wide enough to assure minimum vane interference. Accordingly, rest 26 is only recommended for use with mechanical release aids.

FIGS. 4, 5, 6 and 7

Figure 5:
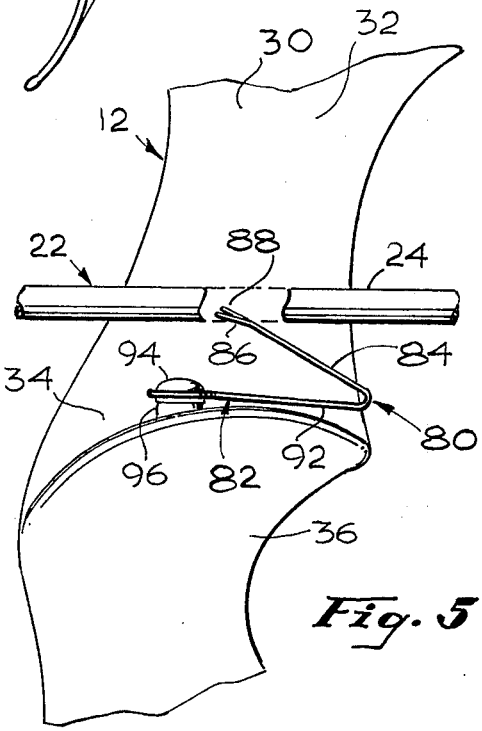
FIG. 5 is a schematic side elevation of the equipment of FIG. 4 on an archery bow.

Bow 12 and arrow 22 are schematically shown in FIG. 5 with a second embodiment of the improved rest of the invention. Thus, a rest 80 is shown replacing rest 26. Rest 80 includes a base 82 and a pair of spaced arms 84 of configuration comparable to arms 56. Thus, arms 84 are resilient and vertically depressible and they extend up and forwardly in window 32, spaced from sidewall 30 and above shelf 34. At their upper ends 86, arms 84 converge then diverge to form a fork 88 but remain spaced from each other to form a passage 90 therebetween through which a vane 28 can freely pass. Shaft 24 is supported on fork 88 as shown in FIG. 5. The lower ends 92 of arms 84 are integral with base 82 which is secured to shelf 34 by a threaded screw 94 and spacers 96.

Figure 6:
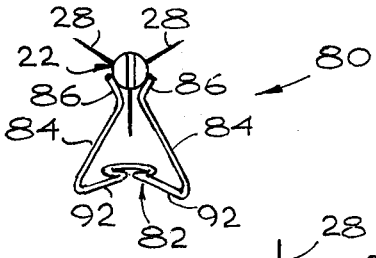
FIG. 6 is a schematic rear elevation of the rest of FIG. 4.
Figure 4:
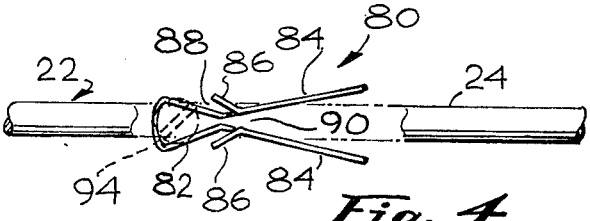
FIG. 4 is a schematic top plan view of a second preferred embodiment of the improved rest of the invention, with an arrow positioned thereon.
Figure 7:
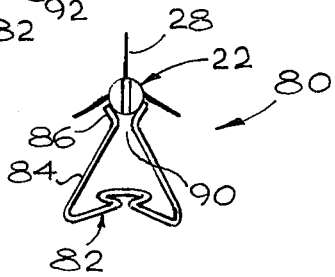
FIG. 7 is a schematic rear elevation of the rest of FIG. 4, with an arrow thereon in a different position from that shown in FIG. 6.

Preferably, arms 84 and base 82 are one continuous piece of strip or wire or the like, as shown in FIGS. 6 and 7. In FIG. 6, rest 80 is shown with arrow 22 thereon so that one vane 28 is disposed in alignment with passage 90. In FIG. 7, rest 80 is shown with arrow 22 thereon so that all three vanes 28 originate above rest 80 and clear it. Whatever the vane configuration, rest 80 can be used in the same manner with the same advantages as rest 26. Both rest 26 and rest 80 can be mounted so that their arms are either directed forwardly or rearwardly, although the former is much preferred. Moreover, each rest can be mounted on and performs equally well on a left-handed bow or a right-handed bow with absolutely no change in rest configuration.

Figure 8:
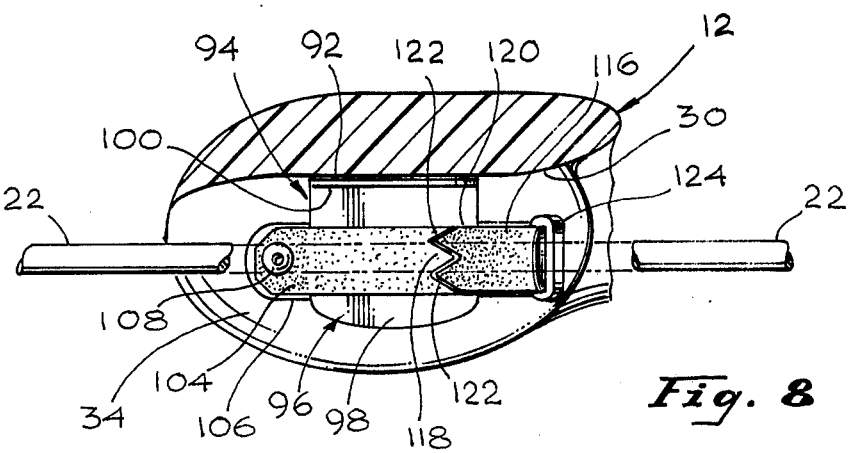
FIG. 8 is a schematic, fragmentary top plan view of a third embodiment of the improved archery equipment of the inventor.
Figure 9:
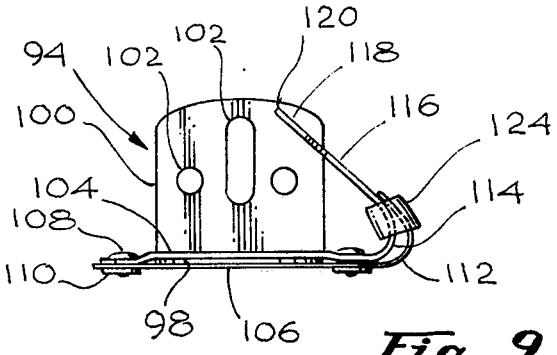
FIG. 9 is a schematic side elevation of the arrow rest portion of the embodiment of FIG. 8; and, FIG. 10 is a schematic rear elevation of a modified arrow rest portion for use in the present invention.

FIGS. 8 and 9

A third preferred embodiment is schematically depicted in FIGS. 8 and 9. Thus, FIG. 8 shows in top plan view a portion of bow 12 to sidewall 30 of which is adhesively secured, via strip 92, a rest 94, upon which arrow 22 is disposed. Rest 94 includes a base portion 96 comprising a horizontal plate 98 integral with a vertical plate 100. To the back of the latter is secured strip 92. Plate 100 is also provided with a plurality of apertures 102 (FIG. 9) through which screws (not shown) or the like can be run, to secure rest 94 to sidewall 30 instead of using strip 92.

Plate 98 is snugly but slideably secured between a top strip 104 and a bottom strip 106. The two strips are secured to each other via anchors 108 and washers 110 (FIG. 9). Strip 106 is turned up at its rear end 112, while strip 104 is also reflected up at its rear portion 114 and then slopes upwardly and forwardly therefrom to form arm 116. Arm 116 is provided with a notched portion or fork 118 at its upper end 120, which form 118 includes a pair of spaced tines 122 adapted to engage shaft 22 on opposite sides below the midline thereof. Strip 106 is additionally secured at rear end 112 to strip 104 via a plastic ring 124 or the like. The height and angle of arm 116 can be adjusted by bending strip 106 at rear end 112. Arm 116 can be adjusted laterally relative to sidewall 30 by sliding the united strips 104 and 106 relative to plate 98, that is, towards or away from plate 100.

Arm 116 is resilient, vertically depressible, elongated, free-standing and upwardly projecting and preferably is of a durable smooth material such as polytetrafluoroethylene plastic or the like. Base support 96 can be metal, plastic or the like, as can strip 106.

FIG. 10

Figure 10:
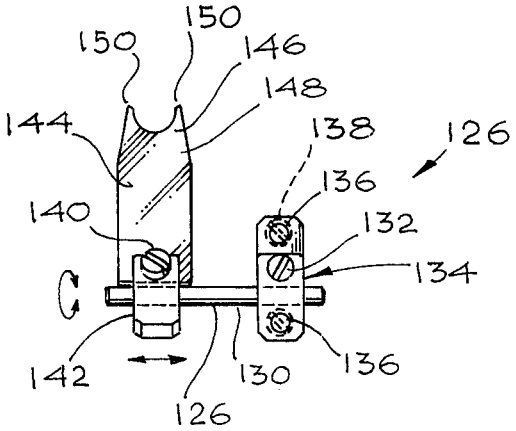

Another single arm embodiment of the improved arrow rest portion of the present invention is shown schematically in rear elevation in FIG. 10. Thus, a rest 126 is shown which includes a base support 128 in the form of a horizontal bar 130, to one end of which is releasably secured, as by a threaded screw 132, a connector 134. Connector 134 includes a pair of spaced holes 136 through which screws 138 are positioned for releasably securing rest 126 in place on bow 12, for example, to the rear end of the sidewall 30 of handle 16 above shelf 34.

To the opposite end of bar 130 is releasably secured, as by a screw 140, a bracket 142 which has an opening (not shown) in the upper end thereof in which an upraised arm 144 is secured. Arm 144 has a notched out fork 146 at its upper end 148. Fork 146 includes a spaced pair of upraised tines 150 adapted to engage opposite sides of arrow shaft 22 (not shown) as previously described for tines 122.

Arm 144 is similar in nature to arm 116 and can be adjusted in vertical height by rotating bracket 142 to the correct position and locking it in place with screw 140. Arm 144 can also be adjusted laterally relative to sidewall 30 (not shown) and connector 134 by loosening screw 140, sliding bracket 142 towards or away from connector 134 and retightening screw 140. Arm 144 can be of similar material to arm 116. Bracket 142, connector 134 and bar 130 can be of metal, plastic or the like.

Rests 94 and 126 are simple, inexpensive and fully adjustable both vertically and horizontally, and they provide for drag-free easy arrow flight with no striking of arrow vanes on any part of either arm 116 or arm 144. Accordingly, the advantages of rest 26 and rest 80 are obtained.

Accordingly, improved archery equipment comprising a bow with improved arrow rest of novel design, construction and advantages is provided. The equipment may also include an arrow on said rest. Various configurations, changes, alterations and additions can be made in the equipment of the invention, its components and parameters. All such modifications, changes, alterations and additions as are within the scope of the appended claims form part of the invention.

What is claimed is:

1. Improved Archery Equipment comprising, in combination:

a. an archery bow having a bow handle including a sidewall and a bottom shelf defining an arrow-receiving space; and, b. an improved reversible arrow rest attached to said bow handle in said arrow-receiving space, said rest comprising, in combination:

i. a base support in said space attached to said bow handle; and, ii. at least one resilient, vertically depressible, elongated, free-standing, upwardly projecting arm rising above said base support in said arrow-receiving space, spaced laterally from and above said bow handle to provide free arrow shaft and vane clearance therefrom and secured adjacent the lower end thereof to said base support, said at least one projecting arm extending generally along the forward-rearward axis of said bow, a portion of said at least one projecting arm providing a fork adjacent the upper end thereof for a shaft of an arrow, said form being dimensioned and positioned with respect to the bow so as to permit all vanes of an arrow, during shooting of an arrow from said bow, to freely clear without striking any part of said at least one projecting arm, including said fork.

2. The improved archery equipment of claim 1 wherein said at least one projecting arm is movable towards and away from said sidewall and said bottom shelf and wherein said at least one projecting arm rises at an angle from the vertical above said base support.

3. The improved archery equipment of claim 2 wherein said rest has only one said at least one projecting arm, wherein said at least one projecting arm is notched at its upper end to provide said fork and wherein said fork has tines adapted to support opposite sides of an arrow shaft below the midline thereof.

4. The improved archery equipment of claim 3 wherein said base support is bendable to vary said angle of rise of said at least one projecting arm.

5. The improved archery equipment of claim 3 wherein said at least one projecting arm comprises flexible plastic.

6. The improved archery equipment of claim 2 wherein said rest has a pair of arms of the type of said at least one which are spaced apart but converge towards each other to provide said fork, said spacing between said pair of arms permitting a vane of an arrow to pass freely therebetween in the area of said fork.

7. The improved archery equipment of claim 6 wherein said upper ends of said pair of arms diverge to form an open centered fork, tines of said fork adapted to support opposite sides of an arrow below the midline thereof.

8. The improved archery equipment of claim 7 wherein said fork is adapted to receive arrows of various diameters and wherein said tines are bendable towards and away from each other to vary the width of said fork.

9. The improved archery equipment of claim 8 wherein the height of said arms in said space is adjustable by bending said arms.

10. The improved archery equipment of claim 9 wherein said arms comprise metal wire.

11. The improved archery equipment of claim 1 wherein said equipment includes an arrow disposed on said rest for shooting from said bow and wherein said at least one projecting arm projects generally along the longitudinal axis of an arrow.

* * * * *